US010508843B2

(12) United States Patent
Schreiber et al.

(10) Patent No.: US 10,508,843 B2
(45) Date of Patent: Dec. 17, 2019

(54) HEAT EXCHANGER WITH WATER BOX

(71) Applicant: Johnson Controls Technology Company, Plymouth, MI (US)

(72) Inventors: Jeb W. Schreiber, Stewartstown, PA (US); Eric H. Albrecht, Dallastown, PA (US); Kevin D. Krebs, Dallastown, PA (US); Justin P. Kauffman, York, PA (US); Brian L. Stauffer, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 232 days.

(21) Appl. No.: 15/385,676

(22) Filed: Dec. 20, 2016

(65) Prior Publication Data

US 2017/0176064 A1 Jun. 22, 2017

Related U.S. Application Data

(60) Provisional application No. 62/270,164, filed on Dec. 21, 2015.

(51) Int. Cl.

| | |
|---|---|
| ***F25B 39/00*** | (2006.01) |
| ***F25B 40/02*** | (2006.01) |
| ***F28F 9/013*** | (2006.01) |
| ***F28F 9/02*** | (2006.01) |
| ***F28D 3/02*** | (2006.01) |
| ***F28D 3/04*** | (2006.01) |
| ***F28D 5/00*** | (2006.01) |

(Continued)

(52) U.S. Cl.

CPC ..... *F25B 39/00* (2013.01); *F25B 40/02* (2013.01); *F28D 3/02* (2013.01); *F28D 3/04* (2013.01);

(Continued)

(58) Field of Classification Search

CPC ..... F25B 40/02; F25B 39/04; F25B 25/005; F25B 2339/047; F25B 2400/13;

(Continued)

(56) References Cited

U.S. PATENT DOCUMENTS 2,360,408 A * 10/1944 Dunn ..... F23K 5/20 165/104.19
2,919,903 A * 1/1960 Vautrain ..... F28D 7/1646 165/110

(Continued)

FOREIGN PATENT DOCUMENTS

JP S53156483 U 12/1978
JP S5573176 U 5/1980

(Continued)

OTHER PUBLICATIONS

PCT International Search Report & Written Opinion for PCT Application No. PCT/US2016/068124 dated Mar. 7, 2017, 12 pgs.

(Continued)

*Primary Examiner* — Frantz F Jules
*Assistant Examiner* — Lionel Nouketcha
(74) *Attorney, Agent, or Firm* — Fletcher Yoder, P.C.

(57) ABSTRACT

Embodiments of the present disclosure relate to a vapor compression system that includes a refrigerant loop, a compressor disposed along the refrigerant loop and configured to circulate refrigerant through the refrigerant loop, and a heat exchanger disposed along the refrigerant loop and configured to place the refrigerant in a heat exchange relationship with a cooling fluid. The heat exchanger includes a water box portion having a first length, a shell having a second length, a plurality of tubes disposed in the shell and configured to flow the cooling fluid, and a cooling fluid portion having a third length, where the water box portion and the cooling fluid portion are coupled to the shell, such that the first length, the second length, and the third length form a combined length of the heat exchanger that is substantially equal to a target length.

19 Claims, 7 Drawing Sheets

(51) Int. Cl.

| | |
|---|---|
| ***F28D 5/02*** | (2006.01) |
| ***F28D 7/00*** | (2006.01) |
| ***F28D 7/16*** | (2006.01) |
| *F25B 39/04* | (2006.01) |
| *F28D 21/00* | (2006.01) |

(52) U.S. Cl.
CPC ..... *F28D 5/00* (2013.01); *F28D 5/02* (2013.01); *F28D 7/0066* (2013.01); *F28D 7/0091* (2013.01); *F28D 7/16* (2013.01); *F28D 7/163* (2013.01); *F28F 9/0131* (2013.01); *F28F 9/026* (2013.01); *F25B 39/04* (2013.01); *F25B 2339/021* (2013.01); *F25B 2339/0242* (2013.01); *F25B 2339/046* (2013.01); *F25B 2339/047* (2013.01); *F25B 2341/0662* (2013.01); *F25B 2400/13* (2013.01); *F25B 2400/23* (2013.01); *F25B 2500/01* (2013.01); *F25B 2500/13* (2013.01); *F25B 2500/18* (2013.01); *F28D 2021/007* (2013.01); *F28D 2021/0071* (2013.01); *F28F 2265/30* (2013.01)

(58) Field of Classification Search
CPC ..... F25B 6/04; F28D 3/02; F28D 3/04; F28D 5/02; F28D 7/1607
See application file for complete search history.

(56) References Cited

U.S. PATENT DOCUMENTS

| | | | | | |
|---|---|---|---|---|---|
| 3,376,917 | A * | 4/1968 | Smith | F25B 39/04 | 165/111 |
| 4,190,101 | A * | 2/1980 | Hartmann | F28F 9/0241 | 165/82 |
| 4,208,529 | A * | 6/1980 | Murray | B01D 53/14 | 165/143 |
| 4,252,186 | A | 2/1981 | Starner et al. | | |
| 4,494,386 | A * | 1/1985 | Edwards | C09K 5/041 | 62/402 |
| 5,212,965 | A | 5/1993 | Datta | | |
| 5,509,466 | A | 4/1996 | McQuade et al. | | |
| 5,996,356 | A | 12/1999 | Kishimoto et al. | | |
| 8,516,850 | B2 * | 8/2013 | Jadric | F25B 31/008 | 62/505 |
| 9,212,836 | B2 * | 12/2015 | Welch | F25B 39/04 | |
| 2010/0006264 | A1 | 1/2010 | Jadric et al. | | |
| 2010/0275643 | A1 * | 11/2010 | Welch | F25B 39/04 | 62/498 |
| 2013/0277020 | A1 * | 10/2013 | Numata | F28F 25/02 | 165/157 |
| 2015/0007604 | A1 | 1/2015 | Hu et al. | | |

FOREIGN PATENT DOCUMENTS

| | | | |
|---|---|---|---|
| JP | S63259363 | A | 10/1988 |
| JP | H04116358 | A | 4/1992 |
| JP | H08233408 | A | 9/1996 |
| JP | 2003065631 | A | 3/2003 |
| JP | 2008298413 | A | 12/2008 |

OTHER PUBLICATIONS

PCT International Search Report & Written Opinion for PCT Application No. PCT/US2016/068106 dated Mar. 10, 2017, 14 pgs.
Japanese Office Action for JP Application No. 2018-551911 dated Jul. 1, 2019, 7 pg.

* cited by examiner

HEAT EXCHANGER WITH WATER BOX

CROSS REFERENCE TO RELATED APPLICATIONS

This application claims priority from and the benefit of U.S. Provisional Application Ser. No. 62/270,164, filed Dec. 21, 2015, entitled "VAPOR COMPRESSION SYSTEM," the disclosure of which is hereby incorporated by reference in its entirety for all purposes.

BACKGROUND

This application relates generally to vapor compression systems incorporated in air conditioning and refrigeration applications.

Vapor compression systems utilize a working fluid, typically referred to as a refrigerant that changes phases between vapor, liquid, and combinations thereof in response to being subjected to different temperatures and pressures associated with operation of the vapor compression system. Refrigerants are desired that are friendly to the environment, yet have a coefficient of performance (COP) that is comparable to traditional refrigerants. COP is a ratio of heating or cooling provided to electrical energy consumed, and higher COPs equate to lower operating costs. Unfortunately, there are challenges associated with designing vapor compression system components compatible with environmentally-friendly refrigerants, and more specifically, vapor compression system components that operate to maximize efficiency using such refrigerants.

SUMMARY

In an embodiment of the present disclosure, a vapor compression system includes a refrigerant loop, a compressor disposed along the refrigerant loop and configured to circulate refrigerant through the refrigerant loop, and a heat exchanger disposed along the refrigerant loop and configured to place the refrigerant in a heat exchange relationship with a cooling fluid. The heat exchanger includes a water box portion having a first length, a shell having a second length, a plurality of tubes disposed in the shell and configured to flow the cooling fluid, and a cooling fluid portion having a third length, where the water box portion and the cooling fluid portion are coupled to the shell, such that the first length, the second length, and the third length form a combined length of the heat exchanger that is substantially equal to a target length.

In another embodiment of the present disclosure, a vapor compression system includes a refrigerant loop, a compressor disposed along the refrigerant loop and configured to circulate refrigerant through the refrigerant loop, an evaporator disposed along the refrigerant loop and configured to evaporate the refrigerant before the refrigerant is directed to the compressor, where the evaporator has a first length, and a condenser disposed along the refrigerant loop downstream of the compressor and configured to place the refrigerant in a heat exchange relationship with a cooling fluid. The condenser includes a water box portion having a second length, a shell having a third length, a plurality of tubes disposed in the shell, and a cooling fluid portion having a fourth length, where the water box portion and the cooling fluid portion are each coupled to the shell, such that the second length, the third length, and the fourth length form a combined length of the condenser that is substantially equal to the first length.

In another embodiment of the present disclosure, a vapor compression system includes a refrigerant loop, a compressor disposed along the refrigerant loop and configured to circulate refrigerant through the refrigerant loop, and a heat exchanger disposed along the refrigerant loop and configured to place the refrigerant in a heat exchange relationship with a cooling fluid. The heat exchanger includes a first water box portion having a first length, a shell having a second length, a plurality of tubes disposed in the shell and configured to flow the cooling fluid, a cooling fluid portion having a third length, and a second water box portion having a fourth length. The first water box portion is coupled to a first end of the shell, the cooling fluid portion is coupled to a second end of the shell, opposite the first end, and the second water box portion is coupled to the cooling fluid portion, such that the first length, the second length, the third length, and the fourth length form a combined length of the heat exchanger that is substantially equal to a target length.

DETAILED DESCRIPTION

Embodiments of the present disclosure are directed towards a heat exchanger that may be utilized in a vapor compression system and that includes one or more water box portions and/or a cooling fluid portion to extend a length of the heat exchanger to a target length. For example, the heat exchanger may include the one or more water box portions that may be coupled to a shell of the heat exchanger that includes a plurality of tubes configured to flow a cooling fluid. The one or more water box portions may not include any tubes, but rather may direct the cooling fluid through a chamber that includes a relatively large volume when compared to the individual volume of the tubes. Additionally, in some embodiments, the cooling fluid portion may also include a relatively large volume chamber that receives cooling fluid from the plurality of tubes. In other embodiments, the cooling fluid portion may serve as an economizer between a condenser and an evaporator of the vapor compression system. As used herein, the economizer may receive refrigerant from the condenser as a two-phase refrigerant (e.g., the refrigerant is directed from the condenser through a first expansion device). The two-phase refrigerant may be separated into liquid and gas, where the liquid is directed to the evaporator (e.g., and a second expansion device) and the gas is directed to the compressor (e.g., an intermediate pressure port of the compressor).

In any case, the one or more water box portions and/or the cooling fluid portion may be sized to extend a length of the heat exchanger to a target length. As heat exchanger tubes become more efficient, a pressure drop of the cooling fluid flowing through the heat exchanger tubes may increase. Accordingly, a length of the heat exchanger tubes may be reduced in order to reduce the cooling fluid pressure drop. However, outer surfaces of the heat exchanger may be utilized to mount additional components of the vapor compression system. Therefore, reducing the length of the entire heat exchanger may remove mounting space, which may ultimately increase a footprint of the vapor compression system (e.g., less mounting space to stack components on top of one another). Accordingly, the length of the heat exchangers may be extended using the one or more water box portions and/or the cooling fluid portion, such that the length of the heat exchanger reaches a target length that may facilitate packaging and/or provide sufficient mounting space for additional components.

Figure 1:
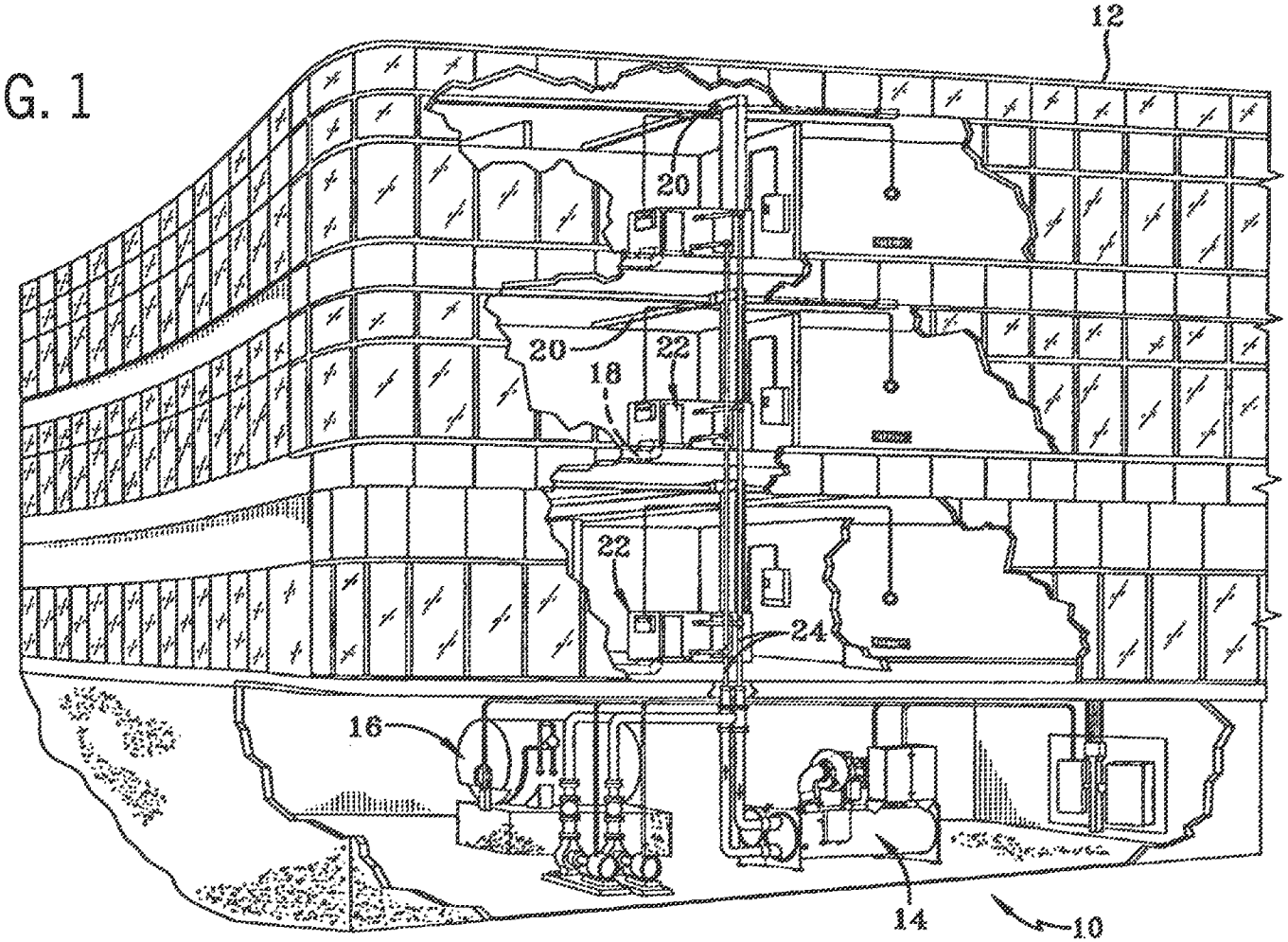
FIG. 1 is a perspective view of an embodiment of a building that may utilize a heating, ventilation, air conditioning, and refrigeration (HVAC&R) system in a commercial setting, in accordance with an aspect of the present disclosure.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
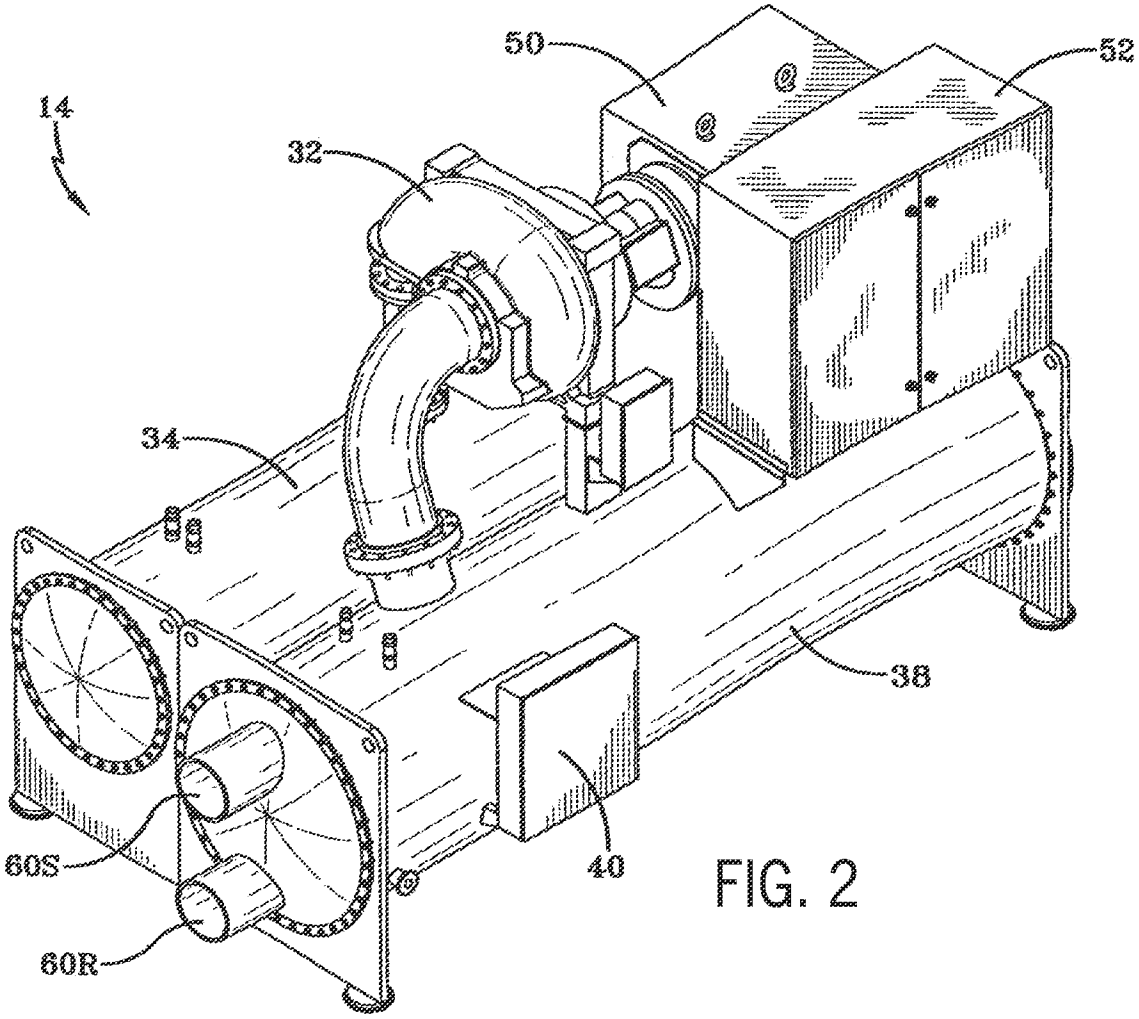
FIG. 2 is a perspective view of a vapor compression system, in accordance with an aspect of the present disclosure.
Figure 3:
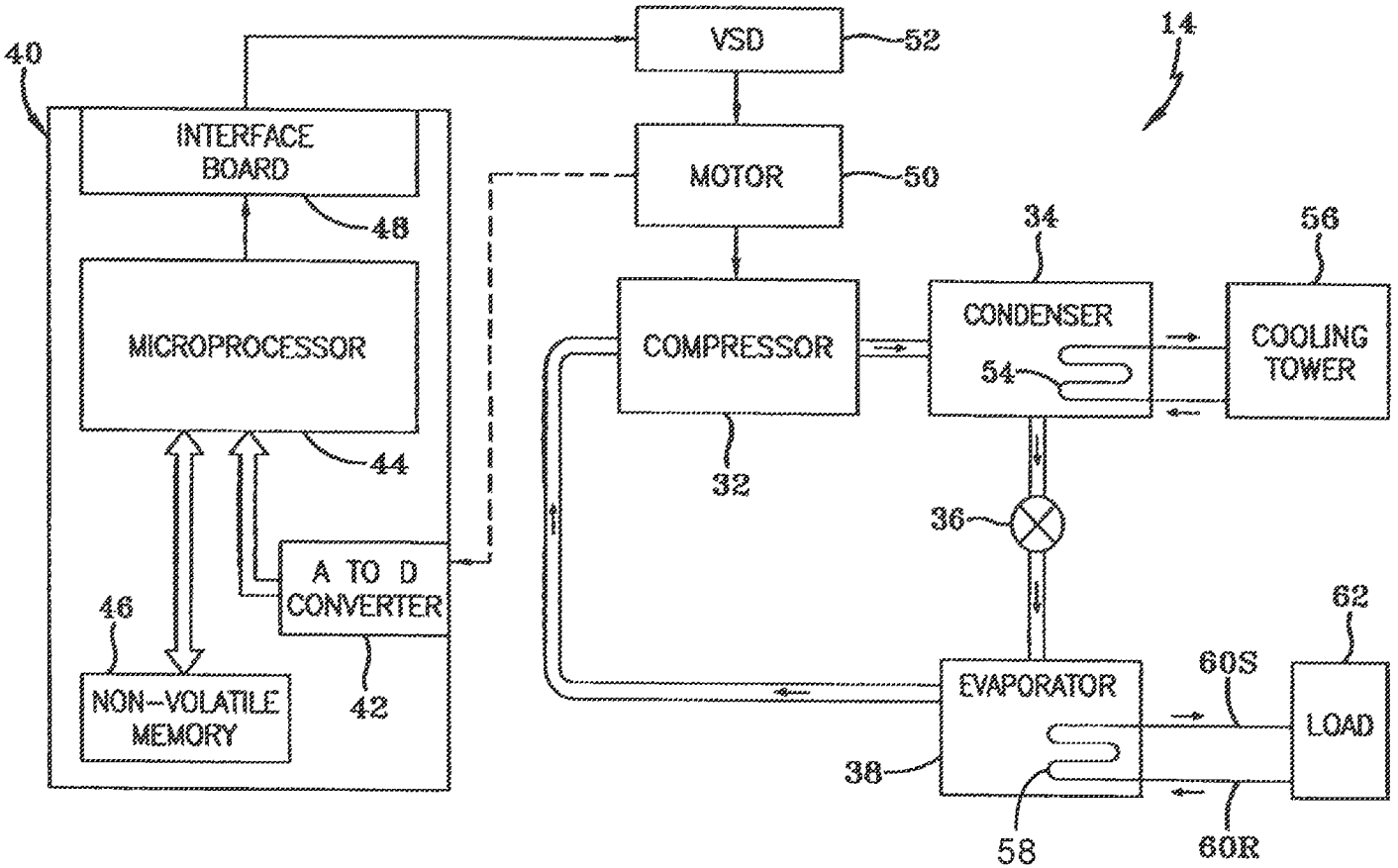
FIG. 3 is a schematic of an embodiment of the vapor compression system of FIG. 2, in accordance with an aspect of the present disclosure.

FIGS. 2 and 3 are embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The liquid refrigerant from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The liquid refrigerant delivered to the evaporator 38 may absorb heat from another cooling fluid, which may or may not be the same cooling fluid used in the condenser 34. The liquid refrigerant in the evaporator 38 may undergo a phase change from the liquid refrigerant to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the vapor refrigerant exits the evaporator 38 and returns to the compressor 32 by a suction line to complete the cycle.

Figure 4:
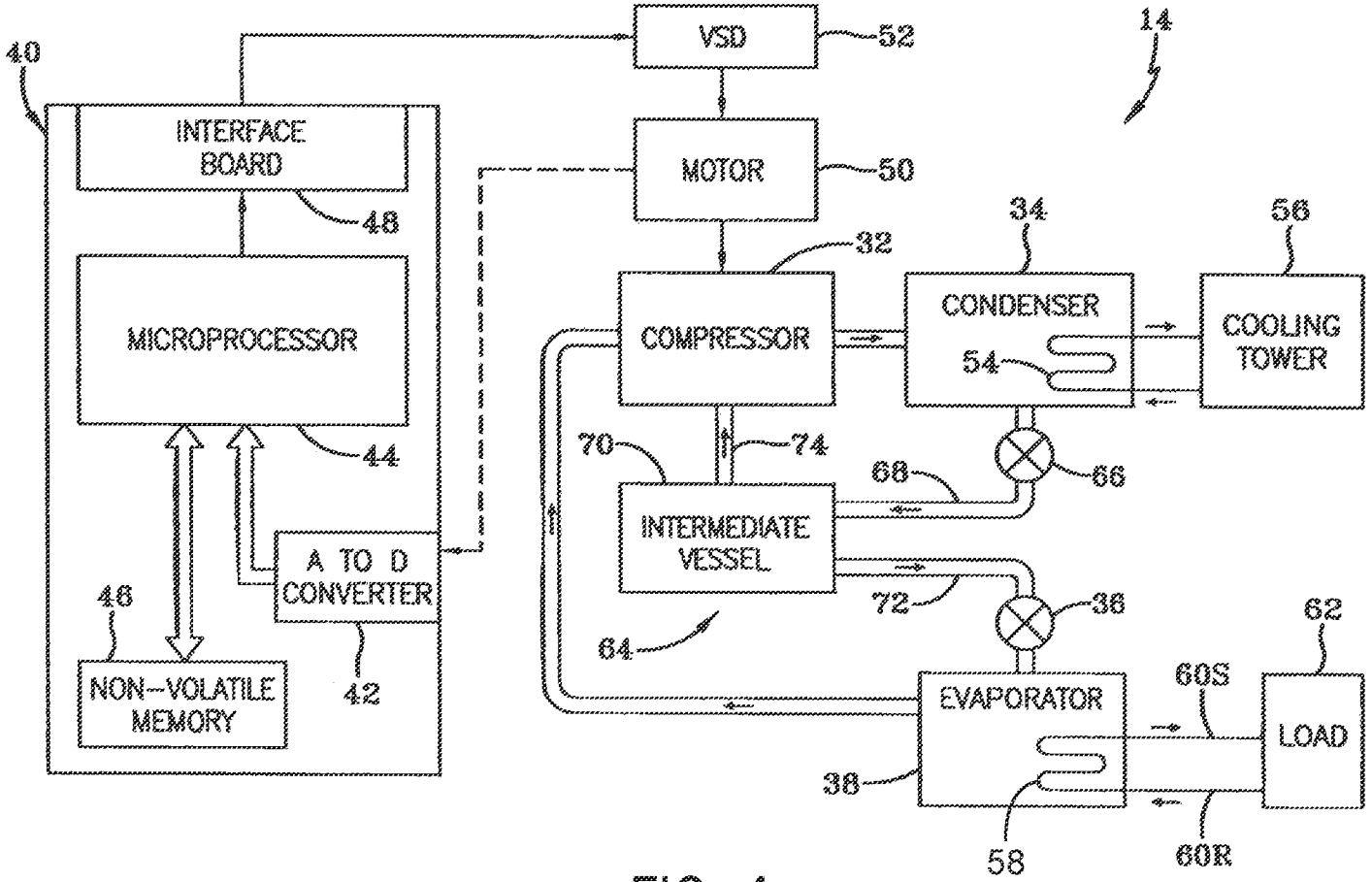
FIG. 4 is a schematic of an embodiment of the vapor compression system of FIG. 2, in accordance with an aspect of the present disclosure.

FIG. 4 is a schematic of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the liquid refrigerant received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the liquid refrigerant because of a pressure drop experienced by the liquid refrigerant when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the liquid refrigerant exiting the condenser 34 because of the expansion in the expansion device 66 and/or the intermediate vessel 70. The liquid from intermediate vessel 70 may then flow in line 72 through a second expansion device 36 to the evaporator 38.

Figure 5:
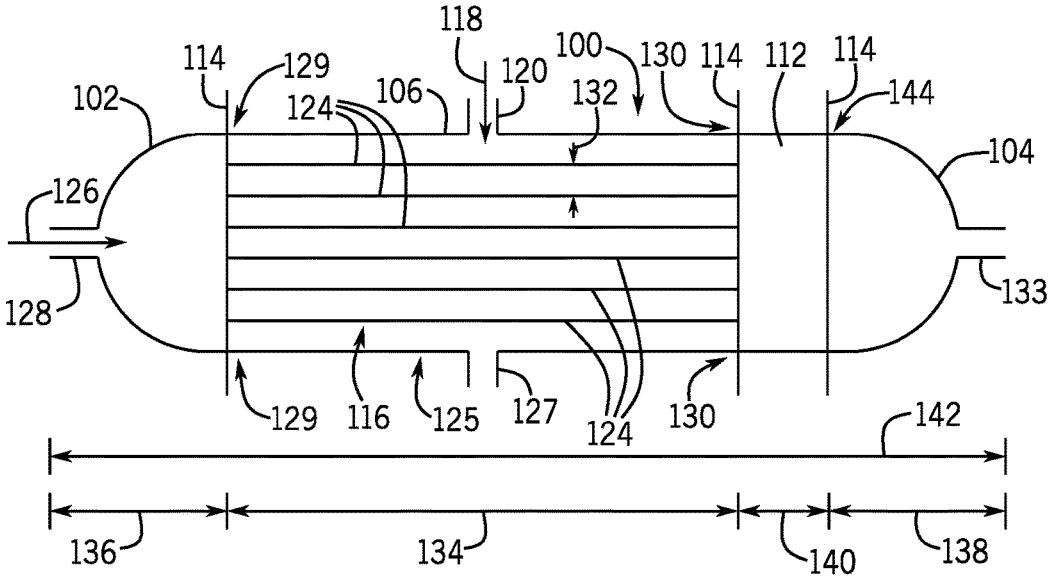
FIG. 5 is a cross section of an embodiment of a heat exchanger that may be utilized in the vapor compression system of FIG. 2 having a first water box portion, a second water box portion, and a cooling fluid portion, in accordance with an aspect of the present disclosure.

As discussed above, a heat exchanger of the vapor compression system 14 may include one or more additional portions that may enable a size of the heat exchanger to reach a predetermined (e.g., target) length. For example, FIG. 5 is a cross section of a heat exchanger 100 (e.g., the condenser 34 or the evaporator 38) that may be included in the vapor compression system 14 and includes a first water box portion 102 and a second water box portion 104. For example, the heat exchanger 100 includes a shell 106 coupled to the first water box portion 102 and the second water box portion 104. In some embodiments, a cooling fluid portion 112 (e.g., a void portion or a portion without tubes) may be positioned between the shell 106 and the second water box portion 104. As shown in the illustrated embodiment of FIG. 5, the shell 106, the first water box portion 102, the second water box portion 104, and/or the cooling fluid portion 112 may be secured to one another via flanges 114. While the illustrated embodiment of FIG. 5 shows the flanges 114 having a larger diameter than the shell 106, the first water box portion 102, the second water box portion 104, and/or the cooling fluid portion 112, in other embodiments, the flanges 114 may include the same diameter as each of the portions 106, 102, 104, and/or 112. In other embodiments, the shell 106, the first water box portion 102, the second water box portion 104, and/or the cooling fluid portion 112 may be coupled to one another using another suitable technique (e.g., welding). Additionally, in some embodiments, each of the shell 106, the first water box portion 102, the second water box portion 104, and/or the cooling fluid portion 112 may be separate components that may be interchanged by coupling and/or removing such components from one another.

The shell 106 may contain a tube bundle 116 that cools a refrigerant 118 that enters the shell 106 through an inlet 120 and ultimately passes over the tube bundle 116, which includes a plurality of tubes 124. The refrigerant 118 may collect in a bottom portion 125 of the shell 106 and flow out of the shell 106 through an outlet 127. Additionally, a cooling fluid 126 may be directed into the first water box portion 102 through an inlet 128. The flange 114 between the first water box portion 102 and the shell 106 may include a plurality of openings corresponding to the plurality of tubes 124 of the tube bundle 116. In some embodiments, the plurality of openings in the flange 114 may receive first ends 129 of each of the plurality of tubes 124 to provide support for the plurality of tubes 124. In any case, the cooling fluid 126 may flow from the first water box portion 102 into the plurality of tubes 124 disposed in the shell 106.

In some embodiments, the flange 114 between the shell 106 and the cooling fluid portion 112 may also include openings that correspond to the plurality of tubes 124, which may direct the cooling fluid 126 exiting the plurality of tubes 124 into the cooling fluid portion 112. Additionally, the plurality of openings in the flange 114 between the shell 106 and the cooling fluid portion 112 may receive second ends 130 of each of the plurality of tubes 124 to provide support for the plurality of tubes 124. In some embodiments, the first ends 129 and/or the second ends 130 of the plurality of tubes 124 may be enlarged when compared to a diameter 132 of the plurality of tubes 124. For example, a mandrel or another suitable tool may be utilized to enlarge the ends 129 and/or 130, such that fluid tight seals may be formed between the plurality of tubes 124 and the corresponding openings of the flanges 114. Once the cooling fluid 126 reaches the second water box portion 104, the cooling fluid 126 may be directed out of the heat exchanger 100 via an outlet 133.

As further shown in FIG. 5, the shell 106 has a first length 134, the first water box portion 102 has a second length 136, the second water box portion 104 has a third length 138, and the cooling fluid portion 112 has a fourth length 140. Accordingly, the heat exchanger 100 has a combined length 142 (e.g., a sum of the first length 134, the second length 136, the third length 138, and the fourth length 140). In some embodiments, the fourth length 140 of cooling fluid portion 112 can be varied, such that the combined length 142 of the heat exchanger 100 is at a predetermined (e.g., target) length. For example, in some embodiments, it may be desirable for the condenser 34 to have the same length and/or cross-sectional area as the evaporator 38 (e.g., to facilitate packaging). However, a cooling capacity of the condenser 34 and a cooling capacity of the evaporator 38 may be different, such that a length of the plurality of tubes 124 in the shell 106 of the condenser 34 is different than a length of the plurality of tubes 124 in the shell 106 of the evaporator 38. A pressure drop of the cooling fluid 126 flowing through the shell 106 may increase as a cooling capacity of the plurality of tubes 124 increases. Accordingly, the first length 134 of the shell 106 (and thus the plurality of tubes 124) may be reduced to minimize a pressure drop while maintaining a relatively high cooling capacity. As a result, the fourth length 140 of the cooling fluid portion 112 may be sized, such that the combined length 142 of the condenser 34 is substantially equal to (e.g., within 5%, within 3%, or within 1% of) the combined length 142 of the evaporator 38. As a non-limiting example, the heat exchanger 100 may be the condenser 34. Once the first length 134 of the shell 106 is calculated (e.g., based on a target cooling capacity of the condenser 34), the fourth length 140 of cooling fluid portion 112 may be determined so that the combined length 142 of the condenser 34 is equal to the combined length 142 of the evaporator 38.

Additionally, in other embodiments, it may not be desirable for the lengths of the condenser 34 and the evaporator 38 to be equal. Accordingly, the fourth length 140 of cooling fluid portion 112 may be customized such that the combined length 142 of the heat exchanger 100 is at a predetermined (e.g., target) length that is suitable for an application of the heat exchanger 100. For example, in some embodiments, it may be beneficial to mount additional components of the vapor compression system 14 to an outer surface 144 of the heat exchanger 100 to reduce a footprint of the system 14 (e.g., by stacking components on one another). Therefore, the fourth length 140 of the cooling fluid portion 112 may be adjusted to provide sufficient space for mounting the additional components.

Figure 6:
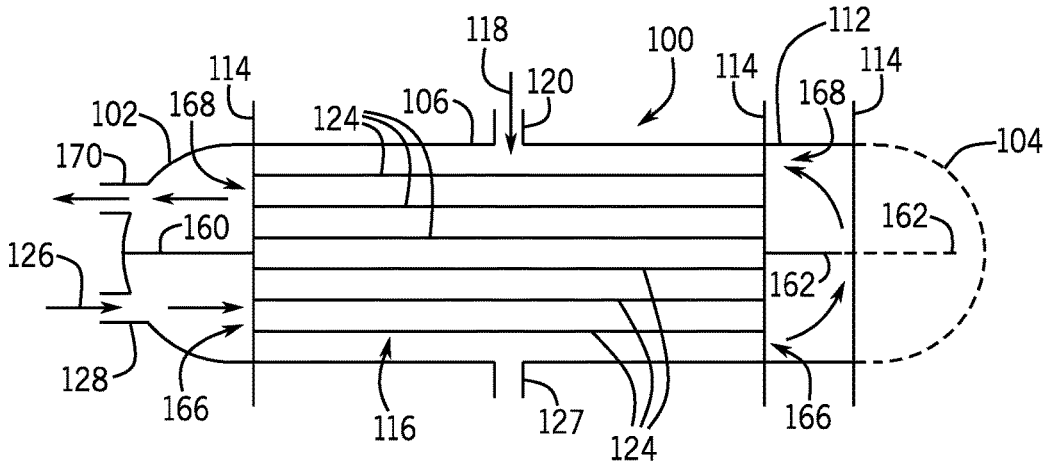
FIG. 6 is a cross section of an embodiment of the heat exchanger that may be utilized in the vapor compression system of FIG. 2 having one or more partition plates, such that the heat exchanger operates as a dual-pass heat exchanger, in accordance with an aspect of the present disclosure.

FIG. 6 is a cross section of an embodiment of the heat exchanger 100 that is configured to operate as a dual-pass heat exchanger. For example, in the illustrated embodiment of FIG. 6, the first water box portion 102 may include a first partition plate 160 and the cooling fluid portion 112 may include a second partition plate 162. In such embodiments, the heat exchanger 100 may not include the second water box portion 104, or the cooling fluid portion 112 may be isolated (e.g., sealed) from the second water box portion 104, such that cooling fluid 126 is blocked from flowing from the cooling fluid portion 112 into the second water box portion 104. However, in other embodiments, the second partition plate 162 may be positioned in the second water box portion 104 in addition to, the cooling fluid portion 112. In such embodiments, the second water box portion 104 may not include the outlet 133, such that the cooling fluid 126 may not flow out of the heat exchanger 100 through the second water box portion 104.

In any case, the cooling fluid 126 may be directed into the first water box portion 102 through the inlet 128, which may be positioned below the first partition plate 160. However, in other embodiments, the inlet 128 may be positioned above the first partition plate. The first partition plate 160 may separate the plurality of tubes 124 in the shell 106 into first pass tubes 166 and second pass tubes 168. Accordingly, the cooling fluid 126 entering the first water box portion 102 may be directed into the first pass tubes 166 of the shell 106. The refrigerant 118 may then be placed in a heat exchange relationship with the cooling fluid 126 in the first pass tubes 166 as it flows over the first pass tubes 166.

In embodiments where the second partition plate 162 is disposed in the cooling fluid portion 112, the cooling fluid 126 may be directed from the first pass tubes 166 to the second pass tubes 168 in the cooling fluid portion 126 because the cooling fluid portion 126 may be isolated (e.g., sealed) from the second water box portion 104, or the second water box portion 104 may not be included. However, in embodiments where the second partition plate is disposed in the second water box portion 104, the cooling fluid 126 may be directed from the first pass tubes 166 to the second pass tubes 168 in the second water box portion 104 because the second water box portion 104 does not include the outlet 133, such that the cooling fluid 126 may not flow out of the heat exchanger 100 through the second water box portion 104. In any case, the cooling fluid 126 may pass through the second pass tubes 168 toward the first water box portion 102. While in the second pass tubes 168, the cooling fluid 126 may again be in a heat exchange relationship with the refrigerant 118 as the refrigerant flows over the second pass tubes 168. As shown in the illustrated embodiment of FIG. 6, the first water box portion 102 includes an outlet 170 disposed above the first partition plate 160, such that the cooling fluid 126 exiting the second pass tubes 168 is directed out of the heat exchanger 100 through the outlet 170, and not mixed with the cooling fluid 126 entering the heat exchanger 100 through the inlet 128. However, in other embodiments, the outlet 170 may be disposed below the first partition plate 160. In any case, the inlet 128 and the outlet 170 may be separated by the first partition plate 160.

Figure 7:
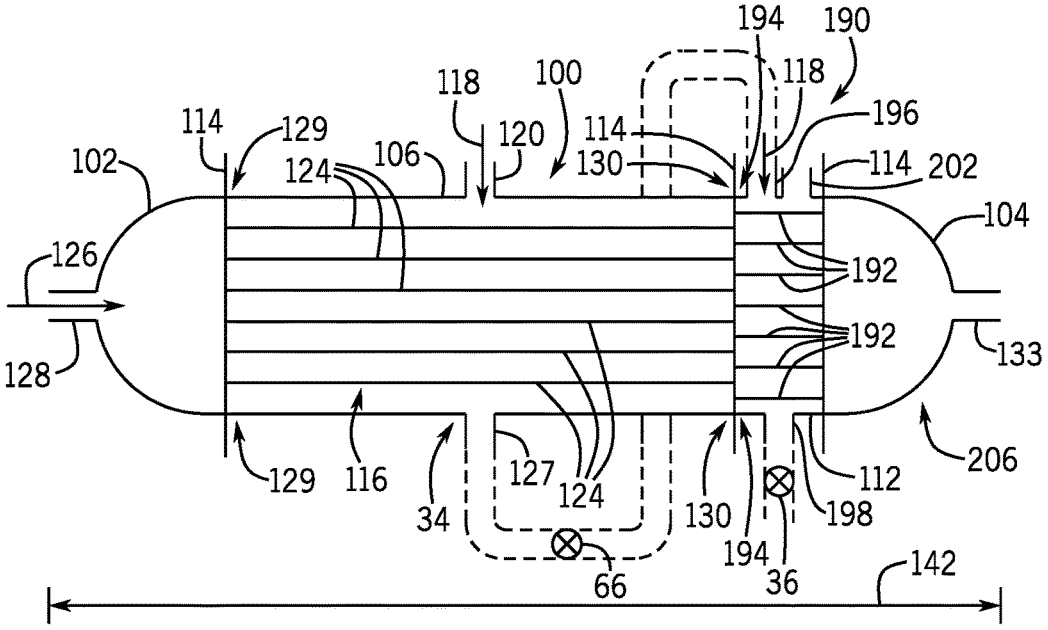
FIG. 7 is a cross section of an embodiment of the heat exchanger that may be utilized in the vapor compression system of FIG. 2, where the cooling fluid portion includes an economizer, in accordance with an aspect of the present disclosure.

In some embodiments, the cooling fluid portion 112 may include a plurality of tubes that are configured to flow the cooling fluid 126 and place the cooling fluid 126 in a heat exchange relationship with the refrigerant 118 and/or another working fluid. For example, FIG. 7 is a cross section of the heat exchanger where the cooling fluid portion 112 includes an economizer 190. As shown in the illustrated embodiment of FIG. 7, the cooling fluid portion 112 includes a plurality of tubes 192, which may direct the cooling fluid 126 from the shell 106 to the second water box portion 104. In some embodiments, the plurality of tubes 124 in the shell 106 may have an enhanced internal surface treatment, which may enhance a heating and/or cooling capacity of the plurality of tubes 124 in the shell 106 and increase a pressure drop of the cooling fluid flowing through the shell 106. As a result, the plurality of tubes 192 in the cooling fluid portion 112 may not include an enhanced internal surface treatment, such that a pressure drop of the cooling fluid flowing through the cooling fluid portion 112 may not be further increased. In some embodiments, the plurality of tubes 192 may be copper tubes, aluminium tubes, steel tubes, and/or tubes having another suitable material without having enhanced internal surface treatment.

In some embodiments, a number of the plurality of tubes 192 in the cooling fluid portion 112 may be the same as a number of the plurality of tubes 124 in the shell 106. In such embodiments, the second ends 130 of the plurality of tubes 124 may be substantially aligned with ends 194 of the plurality of tubes 192 of the cooling fluid portion 112, such that the cooling fluid 126 exiting the plurality of tubes 124 enters corresponding tubes of the plurality of tubes 192. In other embodiments, the number of the plurality of tubes 192 may be different from the number of the plurality of tubes 124, and/or the plurality of tubes 192 may be offset (e.g., not aligned with) the plurality of tubes 124.

Figure 8:
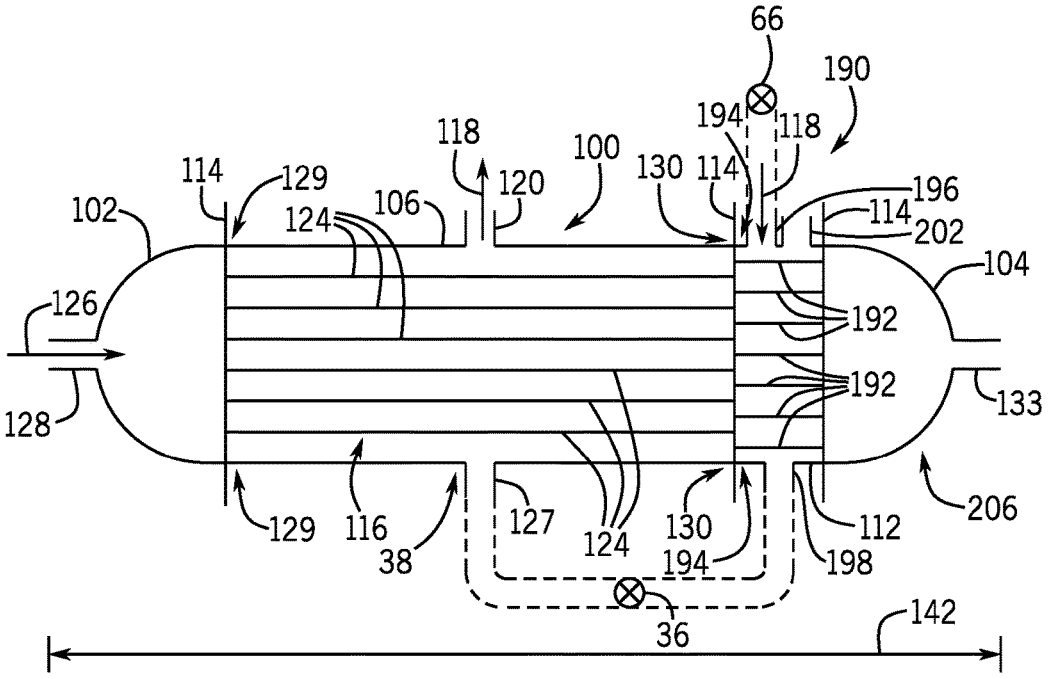
FIG. 8 is a cross section of an embodiment of the heat exchanger that may be utilized in the vapor compression system of FIG. 2, where the cooling fluid portion includes an embodiment of the economizer, in accordance with an aspect of the present disclosure.

As shown in the illustrated embodiment of FIG. 7, the cooling fluid portion 112 may include an inlet 196 and an outlet 198 for the refrigerant 118 and/or another working fluid. In some embodiments, the refrigerant 118 may be directed through the economizer 190 (e.g., the cooling fluid portion 112) after being directed into the shell 106 (e.g., when the heat exchanger 100 operates as a condenser), as shown in FIG. 7. In other embodiments, the refrigerant 118 may be directed through the economizer 190 before being directed into the shell 106 (e.g., when the heat exchanger 100 operates as an evaporator), as shown in FIG. 8. For example, in FIG. 7 the heat exchanger 100 (e.g., the shell 106) operates as the condenser 34. As such, the refrigerant 118 may be directed from the condenser 34 into the economizer 190 after being expanded to a target pressure (e.g., a pressure between a first pressure of the refrigerant 118 in the condenser 34 and a second pressure of the refrigerant 118 in the evaporator 138) in the expansion device 66. In some embodiments, a flow rate, temperature, and/or pressure of the refrigerant 118 flowing into the economizer 190 may be controlled by the expansion device 66. In any case, the refrigerant 118 entering the economizer 190 may further expand to separate the refrigerant 118 into a liquid portion and a gas portion. The liquid portion of the refrigerant 118 may be directed to the expansion device 36 and the evaporator 38 (e.g., the heat exchanger 100 when the heat exchanger 100 operates as an evaporator). The gas portion of the refrigerant 118 may ultimately be directed back to the compressor 32 via a second outlet 202 of the economizer 190 (e.g., the cooling fluid portion 112).

In FIG. 8, the heat exchanger 100 (e.g., the shell 106) operates as the evaporator 38. Accordingly, the refrigerant 118 may be received in the economizer 190 from the condenser 34 and the expansion device 66 through the inlet 196. As discussed above, the refrigerant 118 in the economizer 190 may further expand and separate into the liquid portion and the gas portion. The liquid portion of the refrigerant 118 may be directed through the expansion device 36 and into the outlet 127 (e.g., an inlet in the configuration shown in FIG. 8) of the shell 106 (e.g., operating as the evaporator 38). In some embodiments, the expansion device 36 may control a flow rate, temperature, and/or pressure of the refrigerant 118 entering the shell 106. In any case, the liquid portion of the refrigerant 118 enters the shell 106 and collects within the shell 106, such that the refrigerant 118 is placed in a heat exchanger relationship with the tubes 124. Accordingly, the liquid portion of the refrigerant 118 may ultimately evaporate and exit the shell 106 through the inlet 120 (e.g., an outlet in the configuration shown in FIG. 8).

Figure 9:
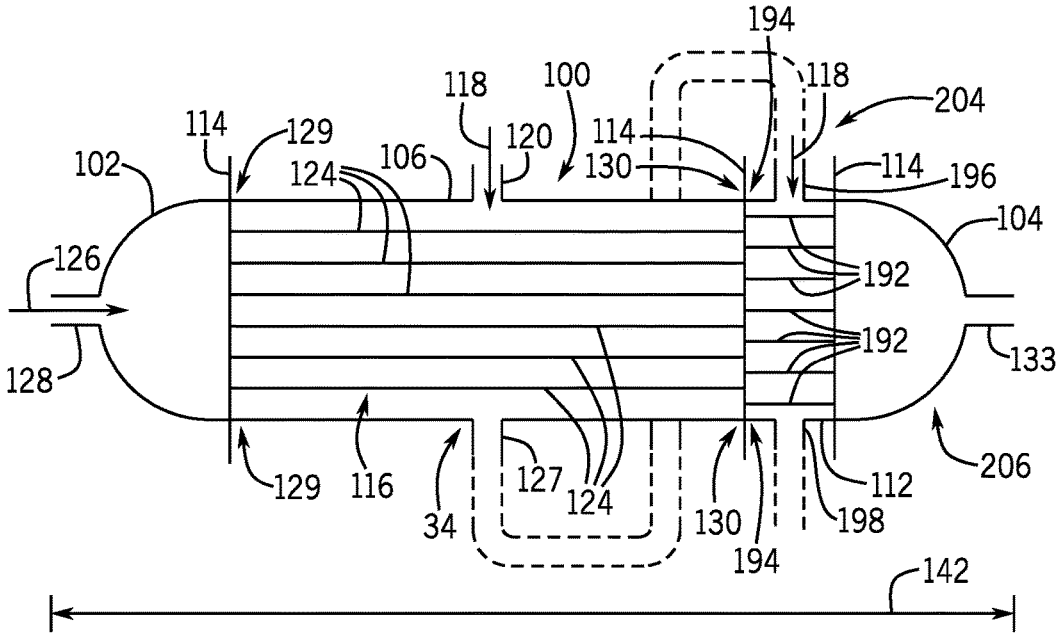
FIG. 9 is a cross section of an embodiment of the heat exchanger that may be utilized in the vapor compression system of FIG. 2, where the cooling fluid portion includes a subcooler, in accordance with an aspect of the present disclosure.

In other embodiments, the cooling fluid portion 112 may be a subcooler 204 configured to further cool the refrigerant 118 exiting the shell 106 through the outlet 127. For example, FIG. 9 is a cross section of the heat exchanger 100 that illustrates the shell 106 operating as the condenser 34 and the cooling fluid portion 112 as the subcooler 204. As shown in the illustrated embodiment of FIG. 9, the refrigerant 118 exiting the outlet 127 of the shell 106 may be directed to the inlet 196 of the cooling fluid portion 112 (e.g., the subcooler 204), which may place the refrigerant 118 in a heat exchange relationship with the cooling fluid 126 flowing through the tubes 192 disposed in the cooling fluid portion 112 (e.g., the subcooler 204). As the refrigerant 118 flows over the tubes 192, thermal energy may transfer from the refrigerant 118 to the cooling fluid 126 in the tubes 192, such that a temperature of the refrigerant 118 is further decreased in the subcooler 204. The refrigerant 118 may then be directed out of the subcooler 204 through the outlet 198. In some embodiments, the refrigerant 118 exiting the subcooler 204 may be directed to the expansion device 36 and/or the expansion device 66 (e.g., depending on whether the intermediate vessel 70 and/or the economizer 190 is included in the system 14).

Although the illustrated embodiment of FIGS. 7-9 show the economizer 190 and the subcooler 204 disposed between the shell 106 and the second water box portion 104, in other embodiments, the economizer 190 or the subcooler 204 may be disposed at an end 206 of the heat exchanger. In such embodiments, the second water box portion 104 may be disposed between the shell 106 and the economizer 190 or the subcooler 204. In still further embodiments, the second water box portion 104 may be aligned with the shell 106 along the combined length 142 of the heat exchanger 100, such that an overall diameter of the heat exchanger 100 is increased at a point where the shell 106 and the second water box portion 104 overlap when compared to the remaining points of the heat exchanger 100. In other words, cooling fluid outlets from the second water box portion 104 may be perpendicular to the shell 106 (e.g., a marine water box).

Figure 10:
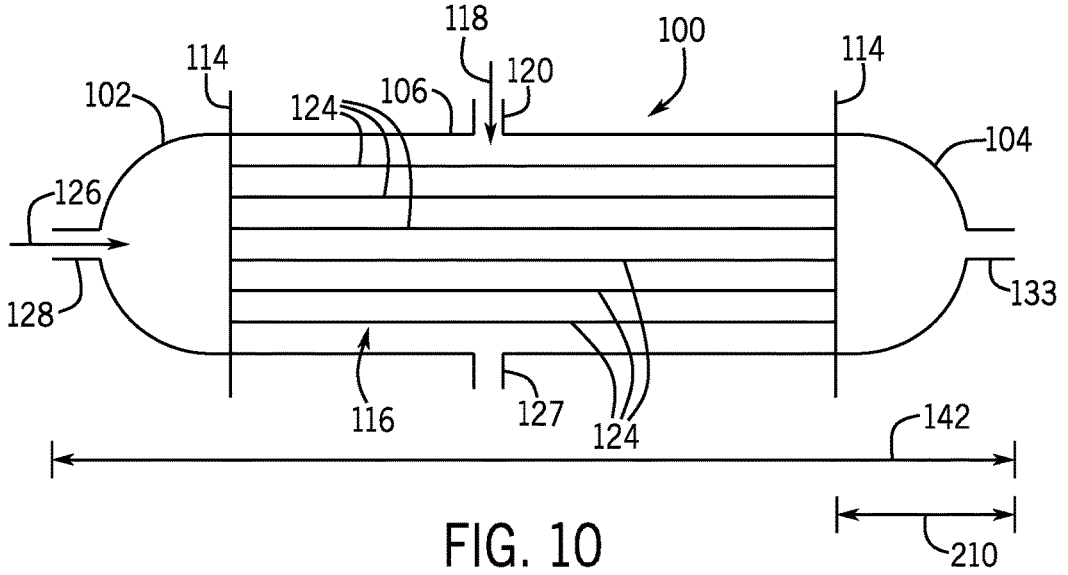
FIG. 10 is a cross section of an embodiment of the heat exchanger that may be utilized in the vapor compression system of FIG. 2 without the cooling fluid portion, in accordance with an aspect of the present disclosure.

In still further embodiments, the cooling fluid portion 112 may be removed from the heat exchanger 100. For example, FIG. 10 is a cross section of an embodiment of the heat exchanger that does not include the cooling fluid portion 112. Accordingly, the second water box portion 104 may be coupled directly to the shell 106. In some embodiments that do not include the cooling fluid portion 112, the combined length 142 of the heat exchanger 100 may be less than embodiments that include the cooling fluid portion 112. However, in other embodiments that do not include the cooling fluid portion 112, the second water box portion 104 may include a fifth length 210 that may be greater than the third length 138 of the second water box portion 104 (see e.g., FIG. 5) when the cooling fluid portion 112 is included in the heat exchanger 100. In other words, the second water box portion 104 may be enlarged, such that the combined length 142 of the heat exchanger 100 is substantially the same as the combined heat exchanger 100 when the cooling fluid portion 112 is included. Accordingly, the combined length 142 of the heat exchanger 100 may be adjusted to reach the predetermined (e.g., target) length.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A vapor compression system comprising:

a refrigerant loop;

a compressor disposed along the refrigerant loop and configured to circulate refrigerant through the refrigerant loop; and a heat exchanger disposed along the refrigerant loop and configured to place the refrigerant in a heat exchange relationship with a cooling fluid, wherein the heat exchanger comprises a water box portion having a first length, a shell having a second length, a first plurality of tubes disposed in the shell and configured to flow the cooling fluid, a cooling fluid portion having a third length, and a second plurality of tubes disposed in the cooling fluid portion, wherein the first plurality of tubes and the second plurality of tubes are offset from one another with respect to an axial length of the heat exchanger, wherein the water box portion and the cooling fluid portion are coupled to the shell, such that the first length, the second length, and the third length at least partially form a combined length of the heat exchanger that is substantially equal to a target length, and wherein the water box portion, the shell, and the cooling fluid portion are coupled to one another via flanges, such that the water box portion, the shell, and the cooling fluid portion are removably coupled to one another.

2. The vapor compression system of claim 1, wherein the heat exchanger comprises an additional water box portion having a fourth length, wherein the additional water box portion is coupled to the cooling fluid portion, such that the first length, the second length, the third length, and the fourth length form the combined length of the heat exchanger that is substantially equal to the target length.

3. The vapor compression system of claim 1, wherein the cooling fluid portion is configured to receive the refrigerant from the shell when the shell operates as a condenser and to direct the refrigerant to the shell when the shell operates as an evaporator, such that the cooling fluid portion is an economizer of the heat exchanger.

4. The vapor compression system of claim 3, wherein a first number of the second plurality of tubes is the same as a second number of the first plurality of tubes.

5. The vapor compression system of claim 3, wherein the economizer of the heat exchanger is configured to expand the refrigerant and separate the refrigerant into a gas portion and a liquid portion.

6. The vapor compression system of claim 5, wherein the economizer is configured to direct the gas portion to the compressor.

7. The vapor compression system of claim 1, wherein the heat exchanger is configured to operate as a dual-pass heat exchanger and comprises a partition plate positioned in the cooling fluid portion.

8. The vapor compression system of claim 7, wherein the partition plate is configured to separate the second plurality of tubes into first pass tubes and second pass tubes, and wherein the cooling fluid is directed through the first pass tubes and then the second pass tubes.

9. The vapor compression system of claim 1, comprising an evaporator configured to evaporate the refrigerant before the refrigerant enters the compressor.

10. The vapor compression system of claim 9, wherein the heat exchanger is a condenser configured to condense the refrigerant exiting the compressor, and wherein the target length is substantially equal to a third length of the evaporator.

11. A vapor compression system, comprising:

a refrigerant loop;

a compressor disposed along the refrigerant loop and configured to circulate refrigerant through the refrigerant loop;

an evaporator disposed along the refrigerant loop and configured to evaporate the refrigerant before the refrigerant is directed to the compressor, and wherein the evaporator comprises a first length; and a condenser disposed along the refrigerant loop downstream of the compressor and configured to place the refrigerant in a heat exchange relationship with a cooling fluid, wherein the condenser comprises a water box portion having a second length, a shell having a third length, a first plurality of tubes disposed in the shell, a cooling fluid portion having a fourth length, and a second plurality of tubes disposed in the cooling fluid portion, wherein the first plurality of tubes and the second plurality of tubes are offset from one another with respect to an axial length of the heat exchanger, wherein the water box portion and the cooling fluid portion are each coupled to the shell, such that the second length, the third length, and the fourth length at least partially form a combined length of the condenser that is substantially equal to the first length, and wherein the water box portion, the shell, and the cooling fluid portion are coupled to one another via flanges, such that the water box portion, the shell, and the cooling fluid portion are removably coupled to one another.

12. The vapor compression system of claim 11, wherein the cooling fluid portion is configured to receive the refrigerant from the shell, such that the cooling fluid portion is an economizer or a subcooler of the condenser.

13. The vapor compression system of claim 11, wherein the water box portion comprises a first partition plate and the cooling fluid portion comprises a second partition plate, such that the condenser operates as a dual-pass condenser.

14. The vapor compression system of claim 11, wherein the condenser comprises an additional water box portion having a fifth length and coupled to the cooling fluid portion, such that the second length, the third length, the fourth length, and the fifth length form the combined length of the condenser that is substantially equal to the first length.

15. A vapor compression system, comprising:

a refrigerant loop;

a compressor disposed along the refrigerant loop and configured to circulate refrigerant through the refrigerant loop; and a heat exchanger disposed along the refrigerant loop and configured to place the refrigerant in a heat exchange relationship with a cooling fluid, wherein the heat exchanger comprises a first water box portion having a first length, a first partition plate disposed within the first water box portion and configured to separate the first water box portion into a first pass section and a second pass section, a shell having a second length, a first set of tubes disposed in the shell and configured to receive the cooling fluid from the first pass section and flow the cooling fluid through the shell in a first direction, a second set of tubes disposed in the shell and configured to flow the cooling fluid through the shell in a second direction, opposite the first direction, toward the second pass section, a cooling fluid portion having a third length, a second water box portion having a fourth length, and a second partition plate extending in the first direction through the cooling fluid portion and disposed within the second water box portion, such that the second partition plate is configured to direct the cooling fluid flowing through the first set of tubes into the second set of tubes toward the second pass section, wherein the first water box portion is coupled to a first end of the shell, the cooling fluid portion is coupled to a second end of the shell, opposite the first end, and the second water box portion is coupled to the cooling fluid portion, such that the first length, the second length, the third length, and the fourth length form a combined length of the heat exchanger that is substantially equal to a target length, wherein the first water box portion, the shell, the cooling fluid portion, and the second water box portion are coupled to one another via flanges, such that the first water box portion, the shell, the cooling fluid portion, and the second water box portion are removably coupled to one another, wherein the second partition plate extends through a flange of the flanges coupling the cooling fluid portion to the second water box portion, and wherein the cooling fluid portion is without tubes.

16. The vapor compression system of claim 15, comprising a condenser having a fifth length and configured to receive the refrigerant from the compressor to condense the refrigerant.

17. The vapor compression system of claim 16, wherein the heat exchanger is an evaporator configured to evaporate the refrigerant that enters the compressor, and wherein the target length is the fifth length.

18. The vapor compression system of claim 15, wherein the cooling fluid portion is configured to receive the refrigerant from the shell when the shell operates as a condenser and to direct the refrigerant to the shell when the shell operates as an evaporator, such that the cooling fluid portion is an economizer of the heat exchanger.

19. The vapor compression system of claim 15, wherein the refrigerant has a normal boiling point of up to 66 degrees Fahrenheit.

* * * * *